US005234361A

United States Patent [19]

Dickinson et al.

[11] Patent Number: 5,234,361

[45] Date of Patent: Aug. 10, 1993

[54] FOILED GRATING FOR JET WATERCRAFT

[76] Inventors: Glenn Dickinson, 11509 Bombardier Ave.; William D. Chapin, 11503 Bombardier Ave., both of Norwalk, Calif. 90650

[21] Appl. No.: 974,084

[22] Filed: Nov. 10, 1992

[51] Int. Cl.[5] ..... B63H 11/03

[52] U.S. Cl. ..... 440/47

[58] Field of Search ..... 440/38, 46, 47; 114/221 R

[56] References Cited

U.S. PATENT DOCUMENTS

| | | | |
|---|---|---|---|
| 3,757,728 | 9/1973 | Rhoda | 440/47 |
| 4,237,812 | 12/1980 | Richardson | 440/47 |
| 4,775,341 | 10/1988 | Tyler et al. | 440/38 |
| 5,114,368 | 5/1992 | Moyle | 440/47 |

FOREIGN PATENT DOCUMENTS

| | | | |
|---|---|---|---|
| 472832 | 3/1992 | European Pat. Off. | 440/46 |

OTHER PUBLICATIONS

Advertisement by Watercross of Texas, "Jet Sports," vol. 11, No. 3 (1992), p. 24, published by Pfanner Communications, Inc., Tustin, CA.

Advertisement by Jet Dynamics, "Jet Sports," vol. 11, No. 3 (1992), p. 66.

Advertisement by PJS Japan, "Jetdream," vol. 46, (Aug. 1992), p. 11, published by Jetdream Co., Ltd., Tokyo, Japan.

Advertisement by Sato Engineering, p. 8 of publication described in Document AT.

Article, "Jetdream," vol. 47 (Sep. 1992), pp. 48–49, published by Jetdream Co., Ltd., Tokyo, Japan.

*Primary Examiner*—Jesus D. Sotelo

*Attorney, Agent, or Firm*—Christie, Parker & Hale

[57] ABSTRACT

A foiled grating is provided for use with a jet-powered personal watercraft. The grating is adapted to be secured substantially across the intake opening in the bottom of the craft's hull and includes a foil and at least two substantially parallel bars oriented longitudinally within the intake opening. The foil is supported by the bars and positioned so as to divide a section of the intake channel into upper and lower portions to direct the intake water flow for a more even flow to the craft's jet pump.

7 Claims, 6 Drawing Sheets

FOILED GRATING FOR JET WATERCRAFT

BACKGROUND OF THE INVENTION

1. Field of the Invention

The invention pertains to jet-powered personal watercraft, and more particularly, to an intake grating with a foil that directs the flow of intake water so as to provide increased stability, speed and improved handling of the craft.

2. Description of Prior Art

Jet powered personal watercraft (hereafter "craft") have become enormously popular in recent years. In a predominant configuration the craft is powered by a small engine located toward the front of the craft's hull. An intake channel is formed in the bottom of the hull somewhat aft of the engine. The channel extends aft to abut a jet pump housing. An impeller is located in the housing positioned coaxially with the engine and connected to it by a drive shaft which extends through the wall of the intake channel. Additionally, a stator is typically fixed in the jet pump housing just aft of the impeller. In operation, the forward motion of the craft, along with the power applied to the impeller, draws in water through the intake channel and propels it out the rear of the pump to produce forward thrust. Steering may be accomplished by providing a mechanism to laterally divert the water as it exits the jet pump.

One disadvantage of the typical craft design is that at high speeds the intake water flow is not uniform across the area of the impeller. Less water is directed toward the upper portion of the impeller relative to the lower portion resulting in diminished efficiency. *Rhoda,* U.S. Pat. No. 3,757,728 discloses a fixed guide vane which functions as a scoop to provide water flow toward the top of the impeller in a large jet-powered boat. This structure protrudes below the plane of the hull to force all the intake water through the upper section of the channel when the boat is operating at maximum speed. Such a scoop has a number of disadvantages when used with smaller, personal watercraft. Personal watercraft make relatively sharp turns and are thus subject to high yaw angles. At a high yaw angle the opening of Rhoda's scoop would not be aligned with the flow of water, thus actually resulting in decreased water flow and craft speed. At the high speeds involved with personal watercraft, the Rhoda scoop would also produce undesirable drag forces and pitching moments, reducing stability. Moreover, contrary to the Rhoda design it is more desirable to have a relatively flush bottom from the standpoint of safety to protect both swimmers and riders. Moreover, as personal watercraft have much smaller engine capacity and pump cavities, the design must be more efficient for satisfactory control and operation.

To avoid damaging the drive train, it is desirable to place some form of grating across the opening in the hull so as to prevent the entrance of large objects into the intake channel. Such a grating is seen in Richardson U.S. Pat. No. 4,237,812. Richardson discloses a grating with a slight scoop formed in the rear of the opening. It does not provide the improvement in stability maneuverability and acceleration of a foiled design.

Moyle, U.S. Pat. No. 5,114,368, attempts to solve this problem by bringing the vane, referred to as a top loading plate, within the intake channel. The vane is supported by a single vertical shaft shielding partition. However, this design suffers from three principal disadvantages. First, use of a single partition does not adequately achieve the grating function. Second, the attachment of the vane to the single partition is structurally unsound because it is not able to adequately resist torque on the vane and, is thus subject to fatigue. Third, the partition may interfere with water flow when the craft is at yaw angles.

SUMMARY OF THE INVENTION

This invention provides an intake grating with an integral foil for use in a jet powered personal watercraft. The grating has two longitudinal bars which extend across the opening of the craft's intake channel, serving to prevent objects from entering the channel and to support the foil. The foil extends upward and aft from its leading edge which is substantially flush with the bars and the hull bottom and is preferably positioned intermediate the ends of the bars. The foil is configured to direct water flow toward the horizontal center-line of the jet pump's impeller, thereby improving efficiency. Additionally, the downforce exerted by the water on the foil produces a slight pitching moment which reduces the tendency of the craft's bow to lift out of the water. By directing water toward the horizontal center-line of the impeller instead of toward the top of the impeller, less turbulence occurs which results in less cavitation. This is important to maintain controlled power or acceleration through the water as well as the handling of the craft.

DETAILED DESCRIPTION OF THE PREFERRED EMBODIMENT

Figure 1:
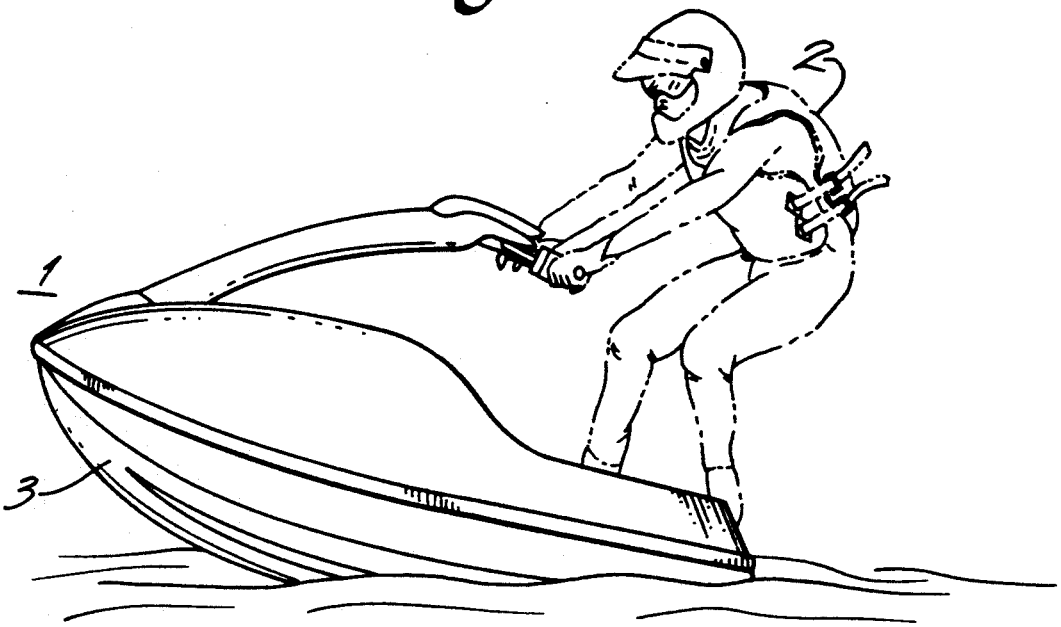
FIG. 1 is a perspective view of a personal watercraft and rider.
Figure 2:
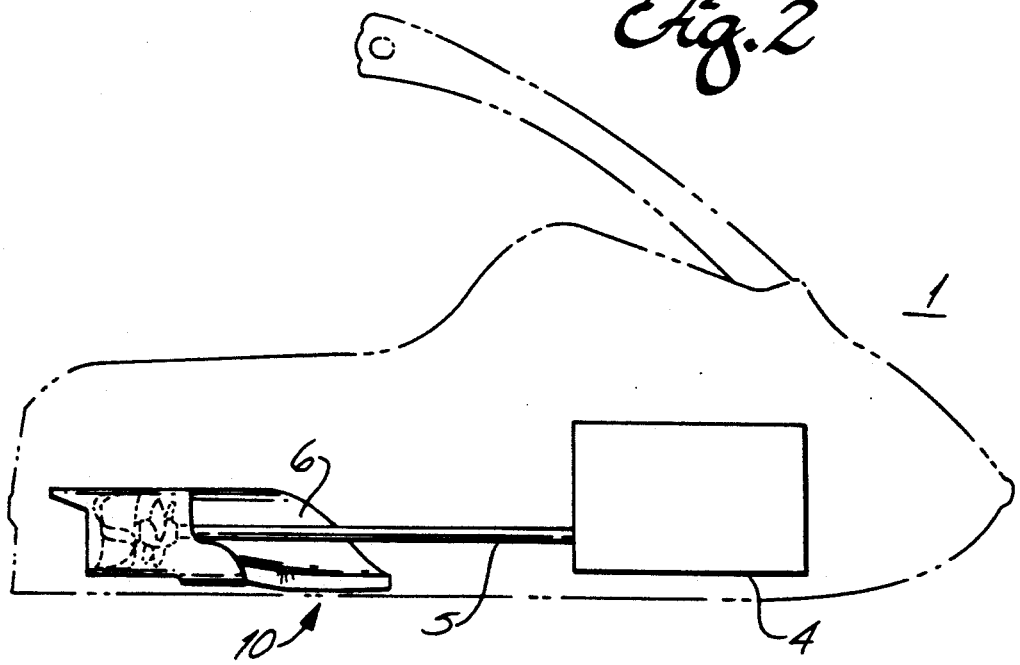
FIG. 2 is a partial side elevational view of a typical personal watercraft, including a foiled grating according to one embodiment of the present invention, with the craft's body and engine shown in simplified phantom.
Figure 3:
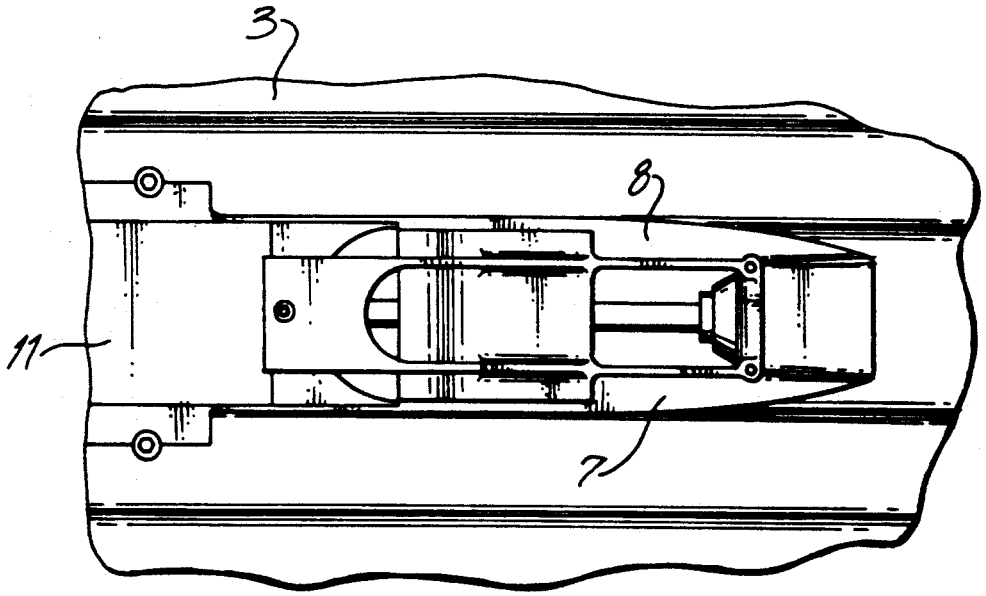
FIG. 3 is a partial bottom view of the intake channel of a craft, including a foiled grating according to one embodiment of the present invention.
Figure 4:
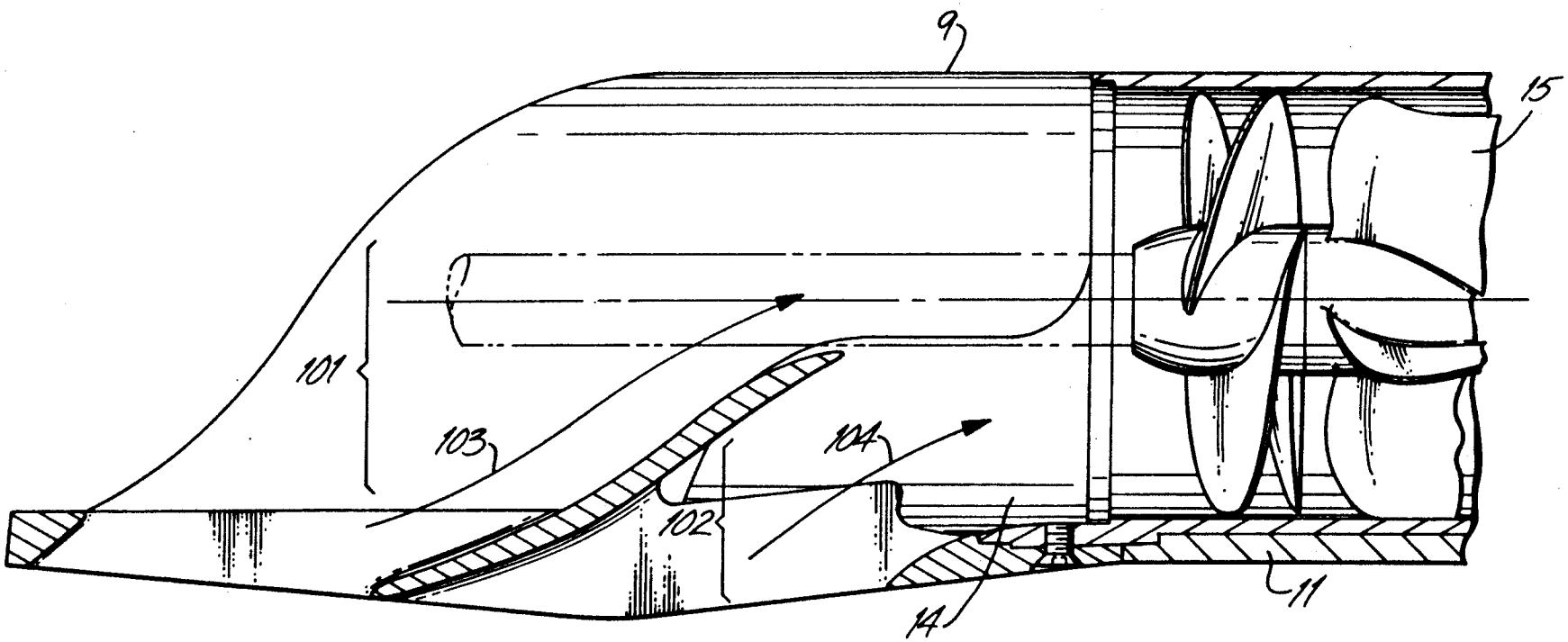
FIG. 4 is a cross-sectional view of a jet-pump housing and foiled grating according to one embodiment of the present invention as seen from one side.

With reference to FIGS. 1-7 of the drawings, wherein like parts are designated by like reference numbers throughout, a personal watercraft I with rider 2 is shown in FIG. 1. In the embodiment disclosed in FIG. 2, the foiled grating is configured such as for use in a KAWASAKI JET SKI model 440 personal watercraft. Configurations for other craft models, varying somewhat in size, etc., are substantially similar. As illustrated in FIG. 2, the craft has an engine 4, a drive shaft 5 and an intake channel 6. The drive shaft is connected to the impeller 13 which is located in pump housing 12 equipped with stator 15. Ride plate 11 is shown in FIG. 3 fitted into the hull bottom to shield the pump housing. The intake channel 6 has port and starboard sides 7 and 8, respectively, as seen from the bottom in FIG. 3. The channel is formed by a hull depression 9 and an extension 14 of the pump housing as illustrated in FIG. 4.

Figure 5:
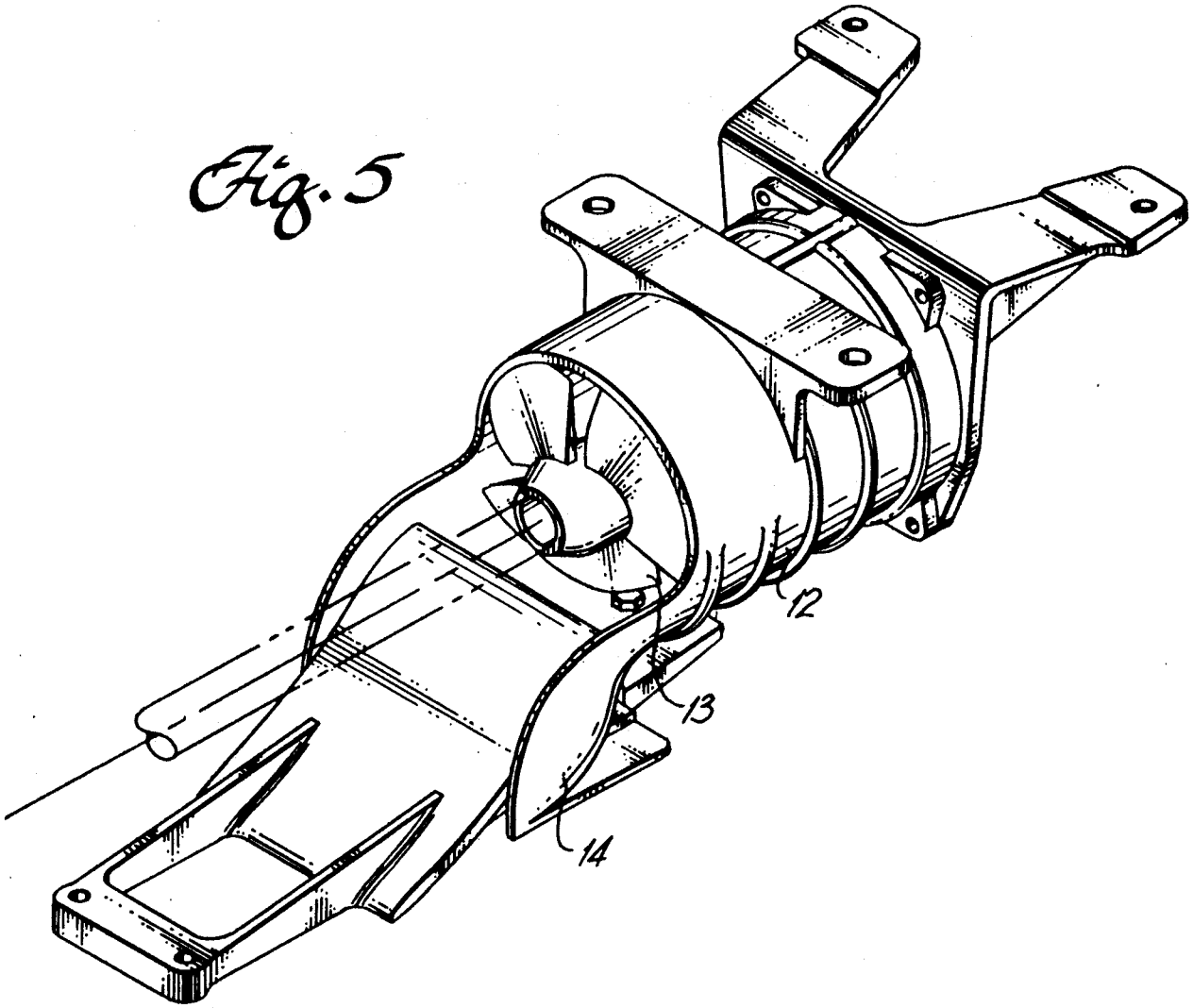
FIG. 5 is a perspective view of the jet-pump housing and foiled grating of FIG. 4.
Figure 6:
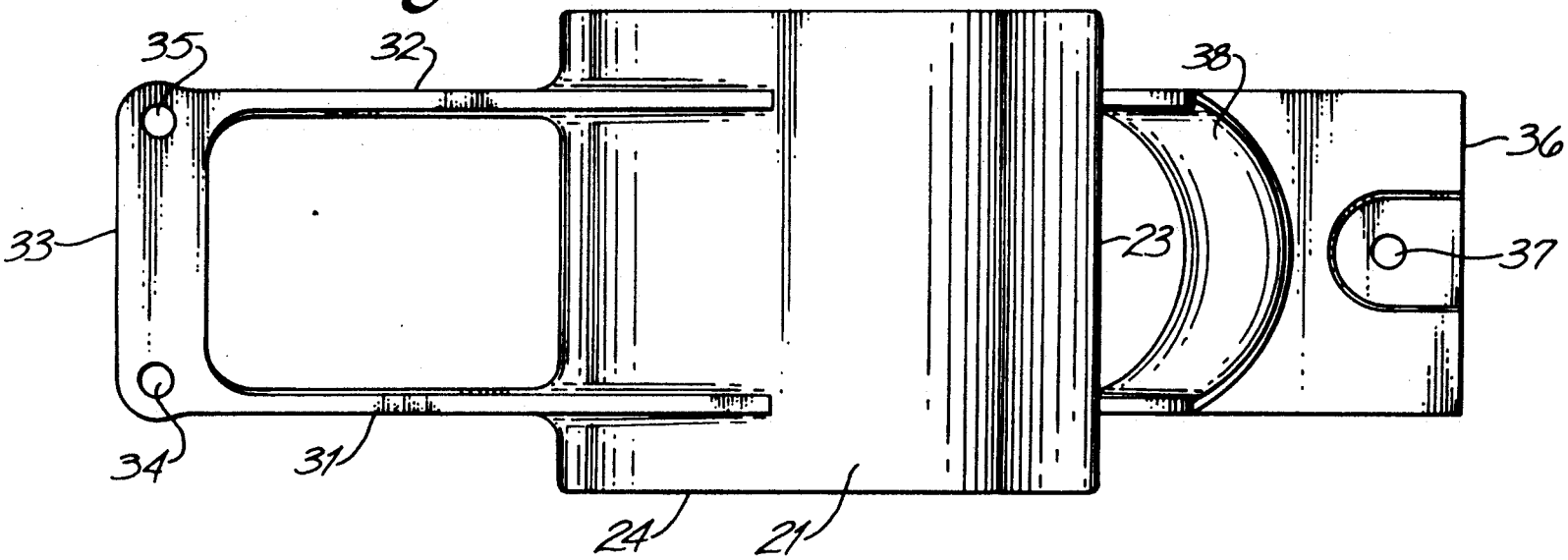
FIG. 6 is a top elevational view of the foiled grating of FIG. 4.

A unitary cast aluminum grating 20 is positioned across the channel opening 10 also as shown in FIGS. 3 and 4. FIG. 5 shows in perspective the positioning of the grating relative to the housing. The grating has port and starboard bars 31 and 32, connected by fore and aft mounting plates 33 and 36, respectively, also shown in FIG. 6. The grating is secured to the hull, such as by means of bolts via forward mounting holes 34 and 35, and is also bolted to pump housing 12 via hole 37. Scoop 38 is formed with lip 39 in the aft plate to provide a smooth interface with a correspondingly raised portion (not shown) of the pump housing entrance. This enables a smooth water flow transition over the grating scoop into the pump housing with minimum turbulence.

The grating also includes foil 20 which divides the channel into respective upper and lower water flow portions 101 and 102, as best seen in FIG. 4. The foil is bounded by leading and trailing edges 22 and 23, port and starboard tips or edges 24 and 25, and upper and lower profiles 26 and 27, respectively. The camber line 29 of the foil is shown in FIG. 7.

As seen in FIGS. 2 and 4, the leading edge of the foil is substantially flush with the hull bottom. The foil continues upward and aft to the trailing edge which lies in proximity to the drive shaft.

Figure 7:
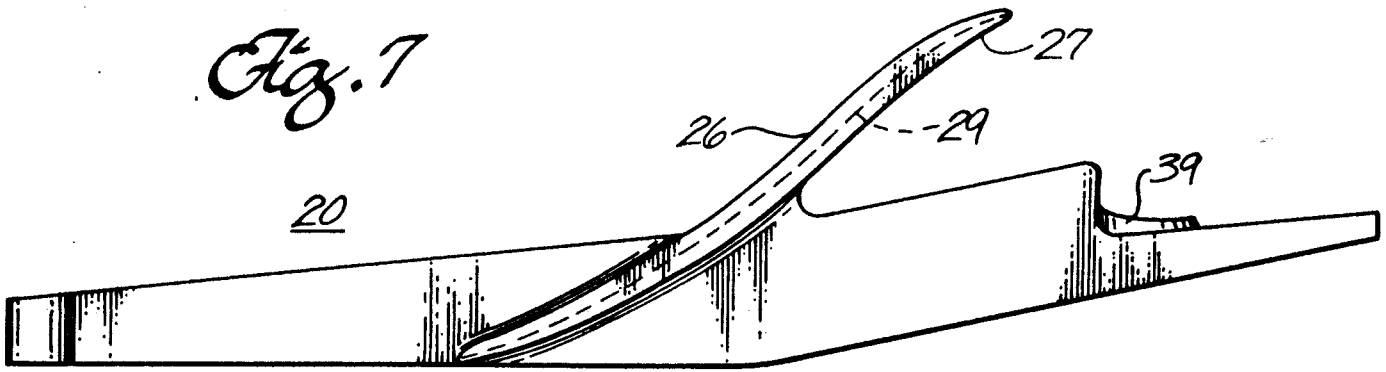
FIG. 7 is a side elevation view of the foiled grating of FIG. 4.

For efficient distribution of the intake water flow, the foil has a varying camber with negative camber (concavity upward) near the leading edge progressing to positive camber (concavity downward) toward the trailing edge, as shown in FIG. 7.

In operation, as the craft moves through the water the foil increases the water flow 103 in the upper channel portion to provide a more even input flow of water to the impeller, thus, increasing its efficiency and increasing the downforce on the craft to increase stability and improve handling.

As shown in FIG. 4, the foil is able to divide the intake water flow 103, 104 substantially in half, however, it is theoretically possible to configure the foil to divide the flow substantially differently. It is important, however, that the foil directs water toward the horizontal center-line of the impeller, thus reducing the turbulence by avoiding the "squeezing effect" on water entering the pump at the top portion of the cavity. This results in less cavitation and is important to maintain control of the craft. Foil placement is influenced both by the need to redirect water for more uniform flow to the impeller and the desire for neutral to slight bow-down pitching moments. If the foil is placed too far forward, the craft will have an excessive tendency to bury its bow in the water; when too far aft, the bow will lift out of the water, decreasing the craft's stability. The optimum location is thus somewhat dependent on the exact model of craft, but it has been empirically determined to correspond to having the leading edge within the middle one-third of the distance along the grating bars. A multi-foil configuration is also possible, but the potential increase in control over the flow that this would offer may be offset by an increased drag factor.

Use of more than one, e.g. two, grating bars prevents the entry of objects into the intake channel while doubly supporting the foil. Another benefit of the use of the foil, as discussed above, is that due to the down force exerted on the foil by the flow of water, a slight bow-down pitching moment which counters the lift on the hull due to the craft's motion can be achieved. Accordingly, the craft stays "hooked-up", in the vernacular of the field.

Figure 8:
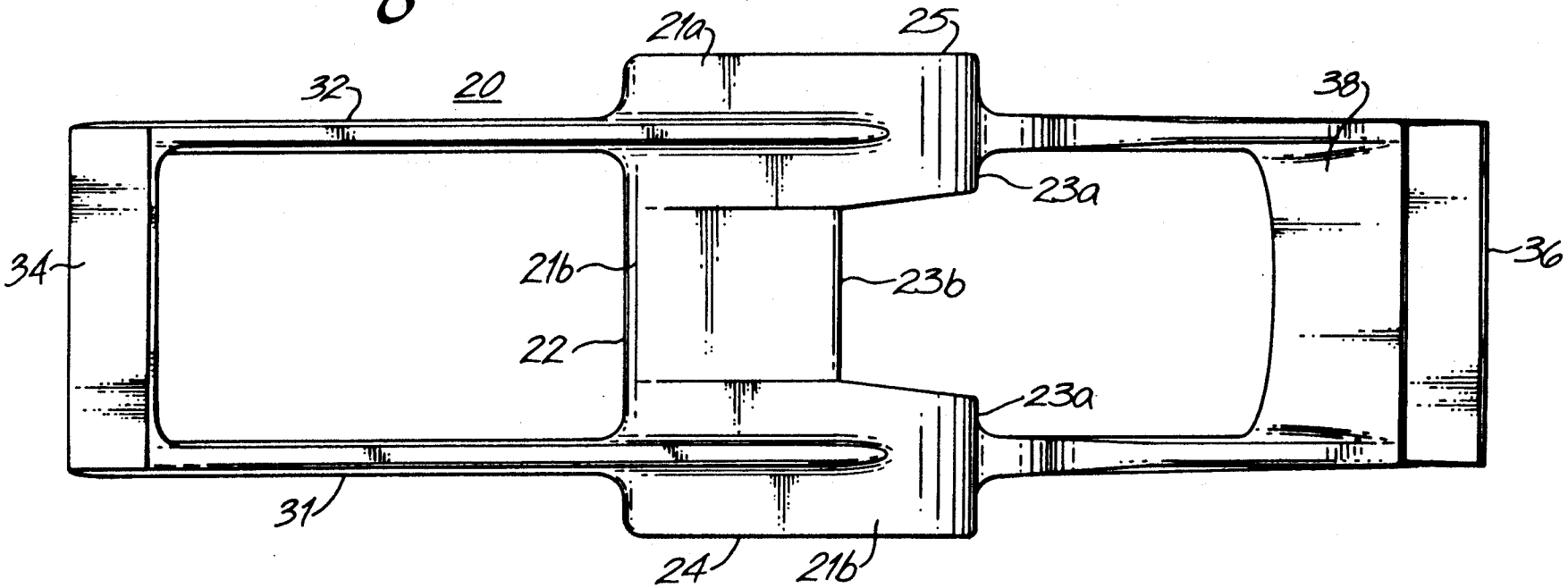
FIG. 8 is a top elevational view of a foiled grating according to a second embodiment of the present invention.
Figure 9:
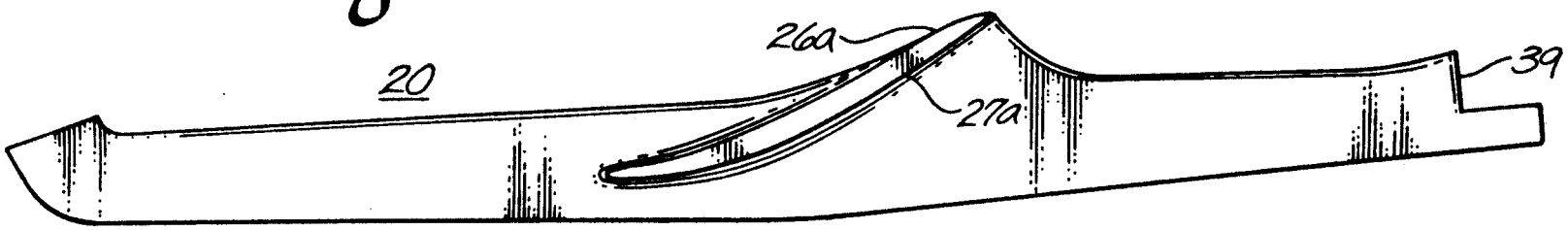
FIG. 9 is a side elevation view of the foiled grating of FIG. 8.

A second embodiment of the present invention, as configured for use in a SEA DOO watercraft by BOMBARDIER, is shown in FIGS. 8 and 9. Like numerals designate like features of the preferred embodiment of FIGS. 6 and 7. The second embodiment is further characterized by lateral foil sections 21*a* bounded by lateral trailing edge 23*a* and a reduced central foil section 21*b* bounded by central trailing edge 23*b*. The reduced section has a smaller chord length (the distance between leading and trailing edges) than the lateral sections'. In the SEA DOO craft, if a foil of the embodiment in FIGS. 6 and 7 were used it would unduly block the water flow if the craft were "spun out" backward, e.g. 180 degree. The reduced center section of the second embodiment allows water to enter the pump cavity under such conditions. Thus the craft can be "spun out" without undue loss of power or acceleration.

Although a preferred embodiment has been disclosed and illustrated, it is apparent from the foregoing that various changes may be made without departing from the invention.

Accordingly, the scope of the invention should be limited only by the claims wherein what is claimed is:

1. A foiled grating for a watercraft which includes a hull having a lower surface with an intake opening, a jet pump means which includes a pump housing and an impeller disposed therein, and an intake channel extending from the intake opening to the pump housing, said grating comprising:

two substantially parallel bars adapted to be oriented longitudinally with respect to said intake opening; and a foil having leading and trailing edges, said foil being supported by said bars so as to divide a section of said intake channel into upper and lower portions when positioned therein, said foil having a profile and a camber line such that adjacent to said leading edge, said camber line is concave in the direction facing said upper channel portion and adjacent to said trailing edge, said camber line is convex in the direction facing said upper channel portion, said grating being sized with respect to said opening so as to be securable substantially across said opening.

2. The grating of claim 1, wherein said foil has port and starboard edges extending beyond said bars.

3. The grating of claim 2 wherein said port and starboard edges substantially extend from the port and starboard sides of said intake channel, respectively.

4. The grating of claim 1 wherein said grating is a unitary casting of aluminum alloy.

5. The grating of claim 1 wherein the bars are connected by fore and aft mounting plates and the leading edge of the foil is located in the middle third of the length of the bars.

6. The grating of claim 5 wherein said foil is positioned so as to divide the intake water flow substantially in half when said watercraft is in motion.

7. The grating of claim 1 wherein said foil has lateral foil sections adjacent to said bars and ar educed foil section between said bars, said reduced section having a chord length smaller than the chord of said lateral sections.

* * * * *

UNITED STATES PATENT AND TRADEMARK OFFICE

CERTIFICATE OF CORRECTION

PATENT NO. : 5,234,361

DATED : August 10, 1993

INVENTOR(S) : Glenn Dickinson; William D. Chapin

It is certified that error appears in the above-indentified patent and that said Letters Patent is hereby corrected as shown below:

Column 4, line 64, change "ar educed" to -- a reduced --.

Signed and Sealed this

Twenty-sixth Day of April, 1994

*Attest:*

BRUCE LEHMAN

*Attesting Officer*

*Commissioner of Patents and Trademarks*